US005655202A

United States Patent [19]

Yoshimura et al.

[11] Patent Number: 5,655,202

[45] Date of Patent: Aug. 5, 1997

[54] FIXING APPARATUS AND FIXING METHOD USING THE SAME

[75] Inventors: Yoshio Yoshimura, Tochigi-ken; Ikuo Takahashi, Utsunomiya; Shuji Watanabe, Tochigi-ken; Koji Akiyama; Koji Shimokusa, both of Wakayama, all of Japan

[73] Assignee: Kao Corporation, Tokyo, Japan

[21] Appl. No.: 603,354

[22] Filed: Feb. 20, 1996

Related U.S. Application Data

[63] Continuation of Ser. No. 275,453, Jul. 15, 1994, abandoned.

[30] Foreign Application Priority Data

Jul. 19, 1993 [JP] Japan ..... 5-200404

[51] Int. Cl.[6] ..... G03G 15/20

[52] U.S. Cl. ..... 399/330

[58] Field of Search ..... 355/282, 285, 355/289, 290; 219/216, 469, 245, 388; 432/60; 399/330

[56] References Cited

U.S. PATENT DOCUMENTS

| | | | |
|---|---|---|---|
| Re. 33,770 | 12/1991 | Torino et al. | 355/290 |
| 3,952,696 | 4/1976 | Saupe | 432/60 X |
| 4,335,951 | 6/1982 | Scribner | 219/216 X |
| 4,611,902 | 9/1986 | Schön | 355/285 |
| 4,689,471 | 8/1987 | Pirwitz et al. | 219/216 |
| 4,822,978 | 4/1989 | Morris et al. | 219/216 |
| 4,859,831 | 8/1989 | Webb | 219/216 |
| 5,046,146 | 9/1991 | Bartman et al. | 219/216 |
| 5,212,529 | 5/1993 | Morris et al. | 355/290 |
| 5,286,950 | 2/1994 | Sakata | 219/469 |
| 5,302,808 | 4/1994 | Sato et al. | 219/216 |
| 5,345,300 | 9/1994 | Uehara et al. | 355/285 |

FOREIGN PATENT DOCUMENTS

| | | | |
|---|---|---|---|
| 0302780 | 12/1990 | Japan | 355/289 |

*Primary Examiner*—Robert Beatty

*Attorney, Agent, or Firm*—Birch, Stewart, Kolasch & Birch, LLP

[57] ABSTRACT

A fixing apparatus for fixing visible images formed on a recording medium has a heat roller having a heating member in the inner portion of the heat roller, and a flat plate-like elastic member forming a nip in contact with the heat roller and capable of exerting a pressure at the nip portion by an elastic stress, the recording medium being fed into the nip portion. According to the fixing apparatus and the fixing method using this apparatus, since a pressure roller is not necessary, the system can be simplified, which leads to miniaturization of the overall fixing apparatus, reduction of overall weight and cost reduction.

7 Claims, 3 Drawing Sheets

FIG.3A
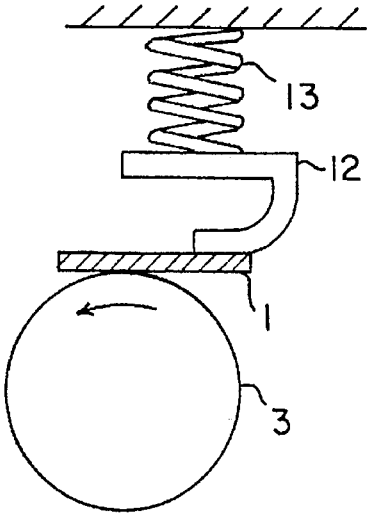
FIG.3B
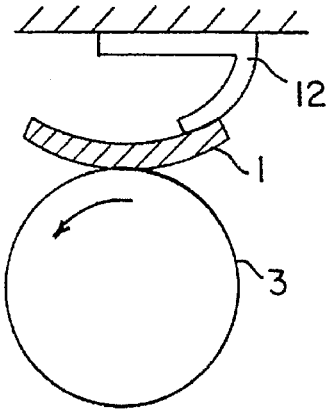
FIG.3C
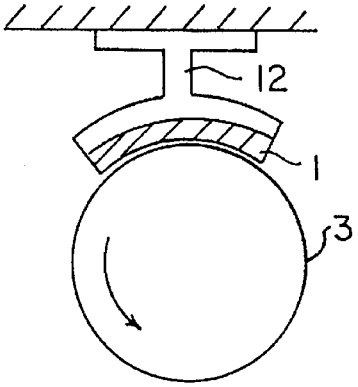
FIG.3D
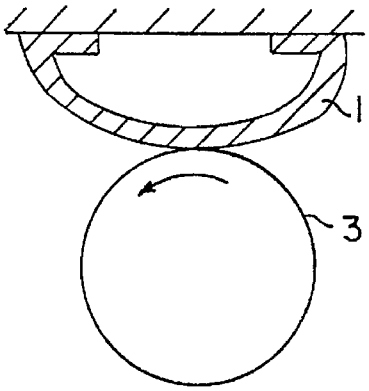
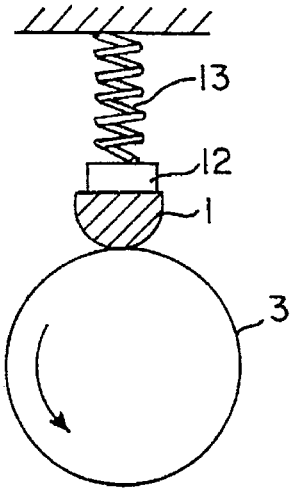
FIG.3E

FIXING APPARATUS AND FIXING METHOD USING THE SAME

This application is a continuation of application Ser. No. 08/275,453 filed on Jul. 15, 1994, now abandoned.

BACKGROUND OF THE INVENTION

1. Field of the Invention

The present invention relates to a fixing apparatus used in an image-forming apparatus such as electrostatic copying machines, printers, or facsimiles, utilizing electrophotographic process. More specifically, the present invention relates to a fixing apparatus used for fixing visible images transferred onto a recording medium, and to a fixing method using such a fixing apparatus.

2. Discussion of the Related Art

In conventional fixing methods and fixing apparatus, used in an image-forming apparatus for fixing visible images transferred onto a recording medium, utilizing electrophotographic process, the following methods have been mainly disclosed and practically used:

(a) A pressure-fixing method for fixing a visible image using a high nip pressure exerted by a pair of metal rollers;

(b) A heat roller fixing method for fixing a visible image using a heat roller comprising a hollow metal cylinder having a heat source in the inner portion thereof, the surface of the hollow cylinder being coated with a releasing layer such as TEFLON coating, and a pressure roller comprising a metal shaft and a silicone rubber layer formed in the periphery of the metal shaft; and (c) A film fixing method for fixing a visible image using a thin film and a linear heating member, in which the pressurizing portion necessary for fixing is intensively heated, thereby shortening the waiting time for the temperature rise in the fixing device.

Further, (d) U.S. Pat. No. 4,689,471 and Japanese Patent Laid-Open Nos. 1-304481 and 2-33175 disclose a heat-and-pressure fixing apparatus comprising a light-weight fixing roller (a heat roller) and a pressure-exerting member of an elongated rectangular shape forming a nip with the fixing roller, wherein fixing is carried out by contacting the fixing roller and a visible image transferred onto the recording medium, and modified apparatus thereof.

Among the above methods, the heat roller fixing method (b) has been known as a typical fixing method. In this method (b), a fixing apparatus comprises a pair of rollers wherein at least one of the rollers is a heat roller having a heat source such as a halogen lamp in the inner portion, and the other roller is a pressure roller coated with a surface layer comprising an elastic layer made of rubbers, etc. The pair of rollers rotates in contact with each other with a suitable nip width by a driving means (see FIG. 2) wherein 2 is a heating means, element 3 a heat roller, element 3*a* a metal roller, element 3*b* a rubber layer, element 4 a pressure roller, element 4*a* a metal shaft, element 4*b* a rubber layer, element 10 a recording medium, element 11 a visible image, and element Wa a nip width However, in the pressure-fixing method (a), a roller with a high surface smoothness is required. Also, in order to achieve good fixing ability, a nip pressure of not less than 10 kg/cm has to be exerted, so that a sturdy structure would be necessary. Therefore, the overall apparatus itself becomes large.

Further, in the heat roller fixing method (b), since fixing is carried out using a heat roller having a heat source in the inner portion thereof together with a pressure roller, the degree of miniaturization is limited. Also, since loads are applied on both ends of the shaft, the rigidity of the roller has to be increased, and crossed axes angle has to be set, in order to evenly exert a nip pressure at the nip portion.

Further, in the film fixing method (c), the overall system is complicated, and the cost of the system entailed by the temperature control and the film deflection control undesirably increases about 1.5 times that of the heat roller fixing method.

Further, in the methods (d) disclosed in U.S. Pat. No. 4,689,471 and Japanese Patent Laid-Open No. 1-304481, etc., since pressurizing is carried out by a separate means, the overall system becomes complicated, thereby making the apparatus large. Also, since the nip width is large, offsetting of the toner is likely to take place at the nip portion of the fixing roller.

SUMMARY OF THE INVENTION

Accordingly, an object of the present invention is to provide a fixing apparatus in which a pressure roller is not necessary, so that fixing apparatus system is simplified, thereby making it possible to achieve miniaturization of the overall apparatus.

Another object of the present invention is to provide a fixing method using such a fixing apparatus.

Specifically, the present invention is concerned with the following:

(1) A fixing apparatus for fixing visible images formed on a recording medium, the fixing apparatus comprising a heat roller having a heating means in the inner portion thereof, and an elastic member forming a nip in contact with the heat roller and capable of exerting a pressure at the nip portion by an elastic stress, wherein the recording medium is fed into the nip portion; and (2) A fixing method comprising the step of carrying out heat-and-pressure fixing of visible images by feeding a recording medium having the visible images formed thereon through the nip portion using the fixing apparatus described in (1) above.

According to the fixing apparatus and the fixing method of the present invention, since a pressure roller is not necessary, the system can be simplified, thereby leading to miniaturization of the overall fixing apparatus, reduction of overall weight and cost reduction thereof.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 3(*a*) through 3(*e*) are schematic views showing various shapes of elastic members of the present invention.

Figure 1:
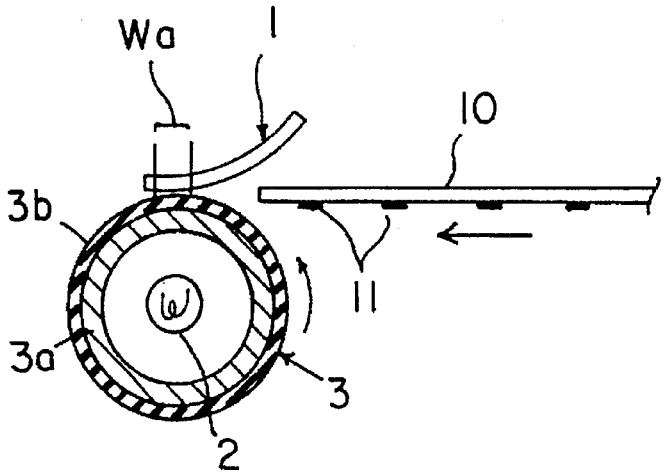
FIG. 1 is a schematic view showing an example of a fixing apparatus of the present invention.
Figure 2:
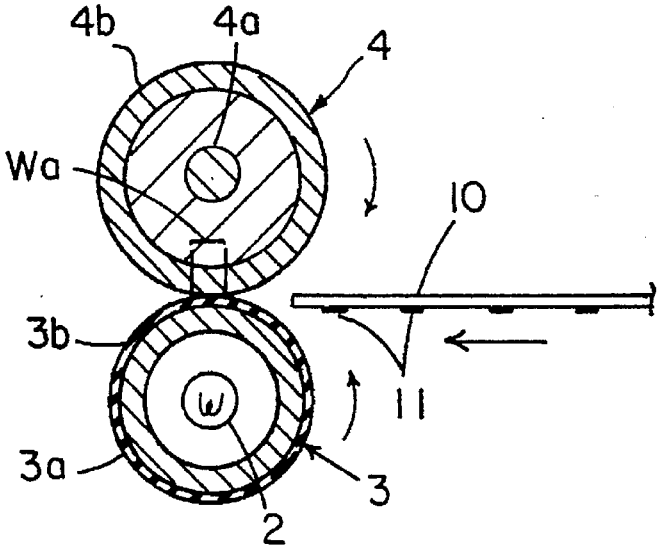
FIG. 2 is a schematic view showing an example of a conventional heat roller fixing apparatus.

The reference numerals in FIGS. 1 through 4 denote the following elements:

Element 1 is an elastic member, element 2 a heating means, element 3 a heat roller, element 3*a* a metal roller, element 3*b* a rubber layer, element 4 a pressure roller, element 4*a* a metal shaft, element 4*b* a rubber layer, element 10 a recording medium, element 11 a visible image, element 12 a holding member for the elastic member, element 13 a compression coil spring and element Wa a nip width.

DETAILED DESCRIPTION OF THE INVENTION

The fixing apparatus of the present invention comprises a heat roller having a heating means in the inner portion thereof, and an elastic member forming a nip in contact with the heat roller and capable of exerting a pressure at the nip portion with an elastic stress, wherein heat-and-pressure fixing of the visible images can be carried out by feeding a recording medium through the nip portion. FIG. 1 is a schematic view showing one example of the fixing apparatus of the present invention, which will be described in detail below.

1 is an elastic member. The elastic member may be made of any materials, as long as the materials are capable of exerting a pressure at the nip portion with an elastic stress, with a preference given to a material showing good sliding property to the recording medium or the heat roller surface. Examples of these materials include fluororesins, silicone resins, polyurethane resins, polycarbonate resins, phenolic resins, nylon resins, poly(ether-ether ketone) resins and polyacetal resins, as well as metals such as SUS steel, copper, aluminum, iron and nickel. Among them, the fluororesins and the silicone resins are preferably used, because they have excellent heat resistance and low frictional resistance.

The elastic member may be of any shape and size, as long as it is capable of evenly exerting a pressure at the nip portion, including elastic members with an even thickness and those with thicknesses varying in tapered forms. FIG. 3 is a schematic view showing various shapes of elastic members wherein 1 is an elastic member, 3 is a heat roller, 12 is a holding member for said elastic member, and 13 is a compression coil spring. Examples of the shapes of the elastic members include, though not limited thereto, those having flat plate-like forms (FIG. 3(*a*), curved plate-like forms (FIGS. 3(*b*), 3(*c*) and 3(*d*)) and rod-like forms (FIG. 3(*e*). Examples of the elastic members having curved plate-like forms include one having a curved plate along the heat roller surface(e.g., see FIG. 3(*c*)), and one having a curved plate outwardly, contacting the heat roller surface only at one point (e.g., see FIGS. 3(*b*) and (*d*)). Among them, a preference is given to the elastic member having a flat plate-like form (e.g., see FIG. 3(*a*)) and the elastic member having a curved plate along the heat roller surface. Further, a greater preference is given to the elastic member having a curved plate, for instance, where entire side of the plate contacts the heat roller surface (e.g., see FIG. 3(*c*)), because, in this case a nip width is constant and independent of a nip pressure, whereas, in all other cases, the nip width increases as the nip pressure increases. Accordingly, depending upon process speed (peripheral speed of heat roller) and roller diameter, the nip width and the nip pressure required for fixing the toner can be freely controlled in the case of FIG. 3(*c*). In general, the thickness of the elastic member is preferably about 0.1 to 10 mm.

The above-described elastic member is arranged partially in contact with the heat roller so that it forms a nip with the heat roller. Specifically, the heat roller is pressed by the elastic member to form a nip therebetween. In this case, appropriate adjustment is made to obtain a given nip width described below and a given nip pressure. The elastic member is arranged in contact with the heat roller so as to exert a pressure evenly along the shaft of the heat roller.

Figure 4:
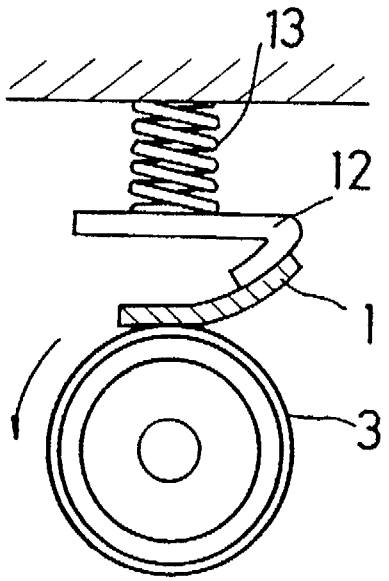
FIG. 4 is a schematic view showing an example of a pressure-controlling means in the fixing apparatus of the present invention.

In addition, the elastic member may be connected with a pressure controlling means for controlling the nip pressure. In this case, the elastic member may be connected with a pressure controlling means directly or indirectly via a holding member. For example, an elastic member 1 is supported by a holding member 12, the holding member 12 being connected to a frame via a pressure controlling means, to allow its free vertical sliding along a bush attached to the frame, and to exert a pressure on a heat roller 3 with the elastic member 1. FIG. 4 is a schematic view in the case where a compression coil spring is used as a pressure controlling means. This figure illustrates an embodiment in which the device illustrated by FIG. 3(*b*) is modified by incorporating a pressure controlling means. Similarly, the device illustrated by FIG. 3(*c*) may also be connected with a pressure controlling means (not shown in the figure). Specifically, FIG. 4 shows that a compression coil spring 13 is used as a means for controlling a pressure applied on the heat roller 3 by the elastic member 1. The pressure controlling means are not limited to those mentioned above, and an air damper, an oil damper, a flat spring or a tension coil spring may be also used therefor. The materials used for the holding member include, but not particularly limited to, aluminum and SUS steel.

In FIG. 1, 3 is a heat roller comprising a metal roller 3*a*, a rubber layer 3*b* and a heating means 2. Any heat rollers can be used for this purpose, as long as they are ones normally used for heat-and-pressure fixing. Examples of metal rollers include those made of known materials such as aluminum, iron and nickel. The rubber layer is a generally known layer comprising such materials as silicone rubbers, silicone sponges, urethane resins, which is coated on the metal roller surface by any known methods.

The heating means are exemplified by generally known heating means such as halogen lamps, ceramic heaters and heating sheets.

To enhance a releasing property of the toner, a releasing layer comprising a fluororesin or the like may be coated on the heat roller surface.

The heat roller 3 is supported by a frame via a bearing, and a driving gear is attached to one end thereof (the frame, the shaft bush and the driving gear, all not shown in the figure), so that the heat roller can rotate by a motor or the like at a given peripheral speed in the direction shown by the arrow in the figure. Although the outer diameter of the heat roller is not subject to limitation, it may range from about 30 to 60 mm as in ordinary fixing apparatuses to about 10 to 30 mm as in miniaturized ones.

With respect to the nip, "Wa" in the figure refers to a nip width, defined as the length of the contacted portion formed between the elastic member 1 and the heat roller 3. In the present invention, the nip is kept almost in the same width along the shaft of the heat roller 3 by adjusting the hardness of the elastic member 1 and the rubber layer 3*b*.

As for the coefficient of friction $\mu_1$ between the elastic member 1 and the recording medium 10, and the coefficient of friction $\mu_2$ between the rubber layer 3*b* and the recording medium 10, the fixing apparatus of the present invention requires the materials such that $\mu_1$ is lower than $\mu_2$. In other words, by using materials which meet the relationship of $\mu_1<\mu_2$, the recording medium can be conveyed without sliding at the nip portion.

10 is a recording medium such as a recording paper, and a visible image 11 transferred onto the surface of the recording medium in the transfer process is fixed to form a fixed image. Specifically, an electrostatic latent image formed by an optical means is developed with a toner in the developing process, after which it is transferred to a recording medium such as a recording paper in the transfer process, and this recording medium is then conveyed to the fixing portion by a given conveying means. Here, any developing methods and transfer methods may be used without limitation. The recording medium having a visible image thus formed thereon is conveyed to the fixing apparatus by a given conveying means not shown in the figure, followed by fixing the visible images by feeding through a nip portion formed between the heat roller 3 and the elastic member 1 thus described. Thereafter, the recording medium 10 is discharged from the system by a given paper discharging means not shown in the figure. In other words, fixing is carried out at the contact surface of the elastic member with the heat roller.

In the fixing method of the present invention, the heat-and-pressure fixing is carried out by feeding a recording medium having a visible image formed thereon through a nip portion of the fixing apparatus described above. As for the fixing pressure for the fixing apparatus of the present invention, the nip pressure is normally from 0.05 to 3.0 kg/cm, preferably from 0.1 to 2.0 kg/cm.

Also, the fixing speed is normally from 10 to 160 mm/sec, preferably from 20 to 120 mm/sec. The fixing temperature, though depending on the kinds of the toners used, is normally from 60° to 220° C., preferably from 70° to 160° C. The nip width is preferably from 0.1 to 10 mm. In the fixing apparatus of the present invention, since a sufficiently wide nip width can be obtained even when the heat roller has a smaller diameter, a small pressure for fixing, a high fixing speed and a low-temperature fixing can be achieved.

Further, the toners used in the present invention may be either a toner obtained by pulverizing and then classifying or an encapsulated toner having functional separation for the core material and shell, the core material having good fixing ability and offset resistance and the shell having good storage stability.

Examples of toners obtained by pulverizing and then classifying include a toner obtained by the method comprising the steps of kneading a coloring agent, a charge control agent, a binder resin and other additives, pulverizing the mixture, and classifying the pulverized product.

Examples of encapsulated toners include those obtained by generally known methods mentioned below.

(1) An interfacial polymerization method, wherein a polymer phase is formed at the interface of each of insoluble two liquid phases by polymerizing the shell material monomers supplied from both the liquid phases.

(2) A complex coacervation method, wherein phase separation of ionic polymer colloids is conducted at the periphery of the core material in a solution.

(3) An in situ polymerization method, wherein the shell material separates from a droplet of mixture solution and the shell forms on the periphery of the core material due to the difference in solubility indices therebetween, while polymerizing the core material monomer.

(4) A spray-drying method, wherein the core material is dispersed in a non-aqueous solution of polymer or polymer-emulsion, and then the dispersed liquid is spray-dried.

The methods for preparing the above encapsulated toners are disclosed, for instance, in Japanese Patent Laid-Open Nos. 58-176642, 58-176643, 61-56352, 63-128357, 63-128358, 1-267660 and 2-51175.

The present invention is not limited to the above-mentioned embodiments, and the kinds of individual members, arrangements thereof, etc. can be suitably modified based on the principles of the present invention.

EXAMPLES

The present invention is hereinafter described in more detail by means of the following working examples, but the present invention is not limited by them.

Fixing is carried out using a modified commercially available copy machine, wherein the fixing portion of the machine is modified to a structure shown in FIG. 1. Specifically, an elastic member 1 comprises a fluororesin (TEFLON, manufactured by Du Pont) shaped into a flat plate with a thickness of 2 mm. A heat roller 3 having an outer diameter of 16.4 mm comprises a metal roller 3*a* which is an aluminum roller having an outer diameter of 16.0 mm, a rubber layer 3*b* which is a silicone rubber layer having a thickness of 200 μm formed on the metal roller 3*a*, and a heating means 2 which is a halogen lamp (100 V, 200 W).

In the fixing apparatus having the above construction, a nip width Wa is set with an even width of about 2 mm along the shaft of the heat roller, a nip pressure is set at 0.3 kg/cm using a compression coil spring (not shown in FIG. 1) as a pressure controlling means. Further, the heating means 2 is controlled so as to set the surface temperature of the heat roller 3 at 140° C. The fixing speed is 40 mm/sec.

Fixing is continuously carried out for 2,000 copies with the above machine using paper sheets as a recording medium 10 under normal environment conditions of room temperature (20°C.). As a result, it has been found that the fixing ability is Good and that no problems are caused by the apparatus used in this example.

The toner used in this example is prepared by the steps of mixing the following starting materials, kneading the obtained mixture, cooling the kneaded mixture, roughly pulverizing using a hammer mill, finely pulverizing using a jet mill, and classifying using an air classifier.

| | |
|---|---|
| Styrene-acrylic acid | 100 parts by weight |
| Carbon black "MOGUL L" (manufactured by Cabot Corporation) | 10 parts by weight |
| Charge control agent "BONTRON N-07" (manufactured by Orient Chemical Co., Ltd.) | 3 parts by weight |
| Polypropylene wax "VISCOL 660P" (manufactured by Sanyo Chemical Industries, Ltd.) | 3 parts by weight |

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixing apparatus for fixing visible images formed on a recording medium, said fixing apparatus comprising a heat roller having a heating means within said heat roller, and an elastic member forming a nip in contact with said heat roller, said elastic member capable of exerting a pressure at a nip portion by an elastic stress, wherein the recording medium is fed into said nip portion, said elastic member having a flat plate-like form.

2. The fixing apparatus according to claim 1, wherein said elastic member has a thickness of about 0.1 to 10 mm.

3. The fixing apparatus according to claim 1, wherein a nip width is 0.1 to 10 mm.

4. The fixing apparatus according to claim 1, wherein said nip pressure is 0.05 to 3.0 kg/cm.

5. The fixing apparatus according to claim 1, further comprising a pressure controlling means connected with the elastic member via a holding member.

6. The fixing apparatus according to claim 1, wherein said elastic member is made of a material selected from the group consisting of fluororesins, silicone resins, polyurethane resins, polycarbonate resins, phenolic resins, nylon resins, poly(ether-ether ketone) resins, polyacetal resins, SUS steel, copper, aluminum, iron, and nickel.

7. A method for fixing visible images formed on a recording medium, comprising the steps of feeding the recording medium into a fixing apparatus comprising a heat roller having a heating means within said heat roller, and an elastic member forming a nip in contact with said heat roller, said elastic member capable of exerting a pressure at a nip portion by an elastic stress, wherein the recording medium is fed into said nip portion, said elastic member having a flat plate-like form; and carrying out heat-and-pressure fixing of visible images formed on the recording medium.

* * * * *